United States Patent [19]

Tucker

[11] Patent Number: 4,976,077

[45] Date of Patent: Dec. 11, 1990

[54] FOUNDATION STANCHION FOR MOBILE HOME FOUNDATIONS APPARATUS AND METHOD

[76] Inventor: Joe W. Tucker, 205 Deer Trace Cove, Cedar Park, Tex. 78613

[21] Appl. No.: 299,603

[22] Filed: Jan. 23, 1989

[51] Int. Cl.[5] ..... E04H 9/14

[52] U.S. Cl. ..... 52/126.6; 52/DIG. 11; 52/126.7; 52/299

[58] Field of Search ..... 52/DIG. 11, 126.6, 126.7, 52/23, 299; 248/352, 357, 354.5, 354.7

[56] References Cited

U.S. PATENT DOCUMENTS

| | | | |
|---|---|---|---|
| 3,178,146 | 4/1965 | Goodale | 248/352 |
| 3,828,491 | 8/1974 | Koon et al. | 52/DIG. 11 X |
| 3,830,024 | 8/1974 | Warnke | 52/DIG. 11 X |
| 4,064,668 | 12/1977 | Carter | 52/DIG. 11 X |
| 4,272,933 | 6/1981 | Lopes | 52/DIG. 11 X |
| 4,560,131 | 12/1985 | Eck | 52/DIG 11 X |

*Primary Examiner*—James L. Ridgill, Jr.
*Attorney, Agent, or Firm*—John N. Shaffer, Jr.

[57] ABSTRACT

An adjustable height stanchion, secured to a concrete member by a tensional anchor, supports a segment of a manufactured structure at its up end. Its design permits its insertion after the anchor is in place and the structure has been placed in its final location and elevation, with very little loss of height adjustment capability. All forms of the invention accommodate misallignment of the structure's longitudinal support member with respect to the previously installed anchor. A preferred form accommodates misallignment by rotating the stanchion around its single anchor bolt for perfect allignment, thereby affording a much needed larger vertical adjustment capability.

22 Claims, 3 Drawing Sheets

SECTION A-A

FOUNDATION STANCHION FOR MOBILE HOME FOUNDATIONS APPARATUS AND METHOD

BACKGROUND OF THE INVENTION

Permanent type foundations for manufactured housing are becoming more desirable and more prevalent as the housing structures become larger, more expensive, and better suited to long term financing. There are a number of permanent foundation systems being used for manufactured housing, including one produced by this inventor, the subject of a patent application filed Mar. 30, 1987, Ser. No. 07/031,741, now U.S. Pat. No. 4,793,110.

Several of these systems use a stanchion arrangement having an extended base means which is attached to a concrete foundation member by means of four anchor bolts embedded in the concrete member. In this arrangement, insertion of the stanchion after the structure is in place and fully lowered is not possible because of the protruding anchor bolts.

A two inch height adjustment range, along with a series of stanchion sizes, is designed to allow support at any height within a predetermined range of support heights. However, it is necessary, when using one of these systems, to place the structure over the concrete foundation members, level it and determine the height necessary at each stanchion, and then raise the structure by two or three inches in order to insert the stanchions over the anchor bolts, after which the structure is lowered again.

Another method sometimes used involves the placement of the structure in the proper location but not lowered, after which the stanchions are chosen for proper height by use of an extended water level, and attached to the anchor bolts, and the structure is then lowered and attached to the stanchions. There is a flaw in this method in that the structure's longitudinal support members are usually not perfectly straight, and sometimes the structure must be raised again to change one or two stanchions to a different size.

Height adjustment is most often accomplished by means of a vertical, threaded support member having some type of securement means at its upper end. Because of the lateral wind forces applied to the upper end of the vertical support member, it must be relatively large. The design load to be borne vertically by the vertical support member is also a factor, particularly if the load is applied at even an inch removed from the vertical axis of the vertical support member.

An ideal stanchion system, and one not found in the art, is one which would furnish four to six inches of vertical adjustment on each stanchion, thereby limiting the inventory required to handle most any installation, to three or four stanchion sizes. Further, the ideal stanchion would be insertable after the structure is permanently lowered, without losing any of its height adjustment capacity.

Most systems currently available have a somewhat limited lateral adjustment capability, usually on the order of three inches total. This is usually provided for by connecting the anchor bolts into slots in the stanchion base. These slots weaken the base and make necessary the use of a heavier material. When more lateral misallignment of the anchor bolts and the structure's longitudinal support member must be accommodated, it is furnished by supporting the structure's longitudinal support member off-center on the vertical support member of the stanchion. This off-center loading reduces the capacity of a given size vertical support member, making the size prohibitive for a member which would afford the desired large height adjustment.

In order for a stanchion system to economically furnish the desired large vertical adjustment, it is then a requirement that the base and body portion of the stanchion furnish an adequately large lateral adjustment capability, so that the stanchion's vertical support member can be centered exactly under the structure's longitudinal support member. The ideal stanchion must also be adapted to placement without loss of height adjustment capability, and without an extra lowering and raising of the structure, or the time consuming use of a water level.

None of the stanchion type support units on the market or known in the patent art at present possesses these desired features.

SHORT STATEMENT OF THE INVENTION

This invention provides a foundation stanchion apparatus and method for manufactured structures which overcomes the disadvantages of those currently available or disclosed in the patent art, while providing a low cost product which is versatile, very light, and extremely easy to install.

By virtue of the layout and design of its anchor receiving means, it can be installed under a fully lowered structure with a very small loss of height adjustment capability, without raising and re-lowering the structure or using a time consuming water level.

One embodiment of the invention offers a height adjustment capability, along with a lateral misallignment accommodation, at the stanchion's upper end, where it joins the structure's longitudinal support member.

Another form of the embodiment immediately above, is constructed with the support and securement device at the stanchion's upper end horizontally offset from the anchor receiving device in the base, making possible the installation of the stanchion in either of two directions, thereby increasing the range over which horizontal misallignment can be accommodated.

A preferred form of the invention uses a single tensional anchor cast or otherwise installed in the concrete, co-acting with a single anchor receiving device in the stanchion's base. The stanchion's support and securement arrangement at its upper end is horizontally offset from the vertical axis of the anchor receiving device in its base, and the stanchion is constructed to withstand the horizontal design load forces at its upper end from any lateral direction.

These three characteristics of this form of the invention, taken together, permit accommodation of substantial horizontal misallignment of the longitudinal support member in respect to the anchor, by means of simply rotating the inserted stanchion about the vertical axis of the anchor, to the position at which exact vertical alignment between the structure's longitudinal support member and the support device is obtained.

The single anchor per stanchion renders the installation of the concrete and anchor much easier than any previous method, and it makes installation of the stanchion much faster. The capability of this embodiment for exact vertical alignment of its support and securement device with the structure's longitudinal support member yields another distinct advantage in respect to height adjustment.

Any stanchion's height adjustable vertical support device must support the horizontal design wind load force at its upper end, along with any torque about its lower portion caused by an off-center application of its vertical loading requirement, which can be a large force.

This preferred form of the invention, by insuring an exact vertical alignment, makes practical a longer vertical support device. This results in a larger height adjustment for each size in the series of stanchion sizes, and a smaller inventory of stanchions to handle the typical installation of a structure on uneven ground.

The securement device of the present invention, when used with a longitudinal support member consisting of a steel I-beam, is installed without welding or drilling operations, and uses only one bolt. It installs quickly and gives a very secure connection.

The base of the stanchion is shown as a rigid plate, in rectangular, round, and/or triangular configurations. It is supported at or near its perimeter, to furnish stability and to offset minor variations in the surface of the concrete to which it is attached.

The body portion of the invention is shown in forms both partly open, and solid, with an access opening, and is shown in pyramidal and conical shapes, both symmetrical and non-symmetrical.

BRIEF DESCRIPTION OF THE DRAWINGS

Other objects, features, and advantages of the present invention will become more fully apparent from the following detailed description, the appended claims, and the accompanying drawings, in which:

FIG. 7 shows the stanchion rotated to its extreme lateral positions, and at an intermediate position; height adjustment capability is demonstrated also;

DETAILED DESCRIPTION

Figure 3:
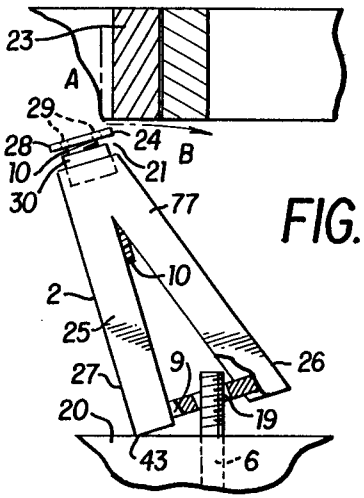
FIG. 3 is a side view of another embodiment of the invention, in the process of insertion under a longitudinal support member at the outside wall of a structure.

In the following detailed description certain specific terminology will be utilized for the sake of clarity and particular embodiments described in accordance with the requirements of 35 USC 112, but it is to be understood that the same is not intended to be limiting and should not be so construed, inasmuch as the invention is capable of many forms and variations within the scope of the appended claims.

In all of the drawings the tensional anchor means 6, 36 is shown as multiple or single anchor bolts, and the anchor receiving means 19 is shown as apertures in the stanchion's base means 9,37,46,61, which is shown throughout as a rigid plate 9,37,46,61, in rectangular, circular, or triangular shape. The vertical support member 10,39,50 of the support and securement means 21 at the upper portion of the stanchion is shown as a threaded rod 10,39 in several embodiments and as threaded tube 50 in one embodiment.

Figure 2:
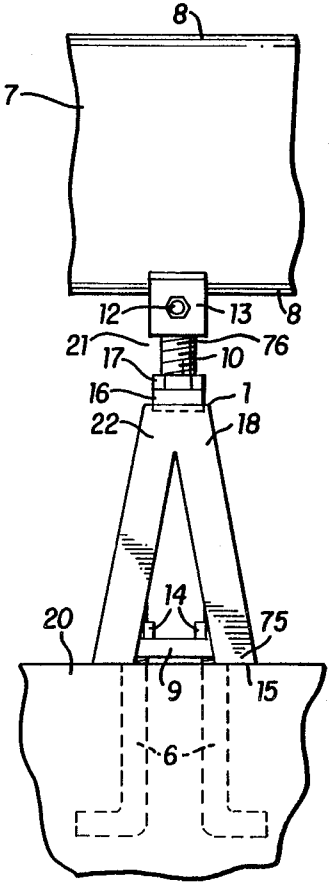
FIG. 2 is a frontal view of the stanchion in FIG. 1.
Figure 1:
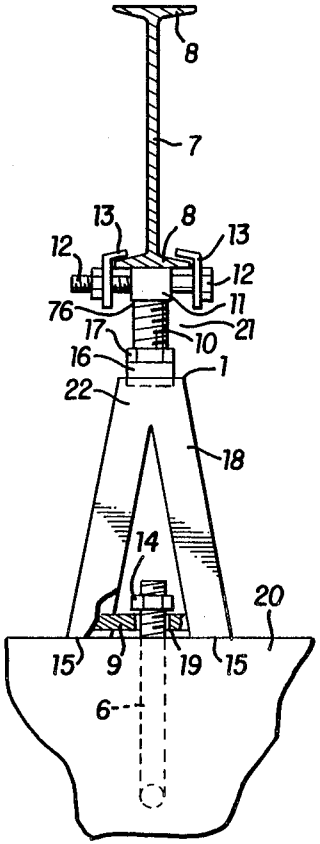
FIG. 1 is a side view of one form of the invention, showing the I-beam longitudinal support member in section.

FIG. 1 is a side view, and FIG. 2 a front view, of a basic stanchion 1, which is secured to concrete member 20 by two anchor bolts 6, connected to stanchion 1's base means 9, comprising a rigid plate 9, by means of apertures 19 and nuts 14. Apertures 19 are larger than anchor bolts 6 in order to allow coupling while stanchion 1 is tilted.

The body means of stanchion 1 consists of four angle steel members 18, which join at their upper ends 22, and attach to respective corners of base plate 9 near their lower ends 15, extending past base plate 9 a short distance, to contact concrete member 20 at their lower ends 15, suspending base plate 9 a short distance above concrete member 20.

A threaded receptacle member 16, which in this embodiment consists of square nut 16, is joined within the upper ends 22 of angle steel members 18, and receives the height adjustable vertical support member 10, which in this embodiment consists of threaded rod 10. Jam nut 17 is positioned upon rod 10 adjacent receptacle member 16.

A cross tube member 11 is attached perpendicularly to vertical support member 10 at its upper end 76, and cross bolt 12 is positioned within cross tube 11 with a flanged washer 13 adjacent each of its respective ends, washers 13 each engaging a respective edge of flange 8 of I-beam member 7, which, in this embodiment, is the longitudinal support member of the structure being supported. I-beam 7 is shown in FIG. 1 in cross section.

Support height is adjusted by turning vertical support member 10, before jam nut 17 is tightened, and before cross bolt 12 and flanged washers 13 are installed.

Anchor bolts 6 are secured to base member 9 by nuts 14, which are installed to exert a very large force upon base member 9. This force is large enough to cause a small permanent deformation of base member 9, which insures that the horizontal wind loading force at the upper portion 21 of stanchion 1 will not cause any of the support points 15 at the lower ends 15 of angle steel members 18 to lose contact with concrete member 20 so long as the yield strength limits of base member 9 are not surpassed.

The bending, or deforming strength of base member 9 is designed such that the design horizontal wind loading at stanchion 1's upper portion 21 is insufficient to increase the small permanent deformation of base member 9 caused at installation by nuts 14 on anchor bolts 6. However, the strength of base member 9 is insufficient to cause anchor bolts 6 to break during installation.

In other words, base member 9 will bend if nuts 14 on anchor bolts 6 are overtightened, before anchor bolts 6 break, but the horizontal wind loading of the stanchion 1 at its upper portion 21 is not large enough to cause base member 9 to bend further.

This design and this installation technique assures the absence of any "rocking" action at the base of stanchion 1,2,3,4,5,60, along with maximization of the material used in base member 9,37,46,61 while eliminating the possibility of breakage of anchor bolts 6,36 during the very secure tightening of the installation technique.

FIGS. 1 and 2 illustrate the use of two anchor bolts 6 per stanchion 1, and show that the body of this embodiment, composed of four angle steel members 18, is shaped approximately like a symmetrical, truncated pyramid.

FIGS. 1 and 2 demonstrate that the anchor means 6 and anchor receiving means 19, in this embodiment anchor bolts 6, secured in concrete member 20, and apertures 19 in base plate 9, are located along a line parallel to the longitudinal support member 7, which in this embodiment is I-beam 7.

Figure 4:
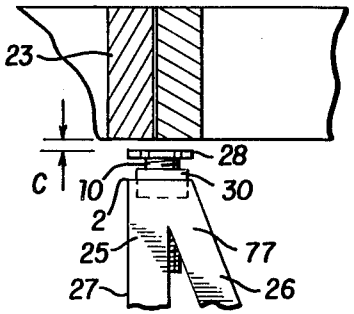
FIG. 4 shows the stanchion of FIG. 3 in place, indicating the small loss of height adjustment capability during insertion.

FIGS. 3 and 4 demonstrate that a similar layout of the anchor means 6 also permits insertion of the stanchion 2 of this invention after longitudinal support member 23, sill 23, is fully and finally lowered, and with very little loss of vertical adjustment capability.

A large vertical adjustment capability is desired; however, each additional inch raises the size and cost requirements of the vertical support member, threaded rod 10, and the receptacle members 16 and 30. Therefore, elimination of almost all the loss of adjustment capability normally associated with stanchion insertion, as demonstrated by FIGS. 3 and 4, is an important object of this invention.

FIG. 3 shows the insertion procedure for stanchion 2, which is an embodiment of the invention used for structures using a wood sill 23 as the longitudinal support member 23. Stanchion 2 is positioned with apertures 19 in base member 9 positioned above anchor bolts 6, in a tilted attitude with its upper end 24 beside, and above the lower portion of, sill 23. Stanchion 2 is then moved downward as at "A", to the position shown in FIG. 3.

Apertures 19 accommodate this movement because they are larger than anchor bolts 6. The top end 24 of stanchion 2 is then rotated as at "B" to its final position as shown in FIG. 4. "C" in FIG. 4 indicates the very small loss of vertical adjustment capability of vertical support member 10, associated with this method of insertion.

All embodiments of this invention are insertable with this same very small loss of adjustment capability.

The body means 77 of the embodiment shown in FIGS. 3 and 4 is composed of two angle steel members 25 and two longer angle steel members 26, to form an approximate pyramid shape having one vertical side 27. Horizontal top plate 28 has vertical apertures 29 for attachment to sill 23.

Threaded receptacle member 30 has a larger vertical dimension than nut 16, and does not require a jam nut 17. Vertical support member 10 is shown in an upper position in FIGS. 1 and 2, and near its lowest position in FIGS. 3 and 4.

Figure 5:
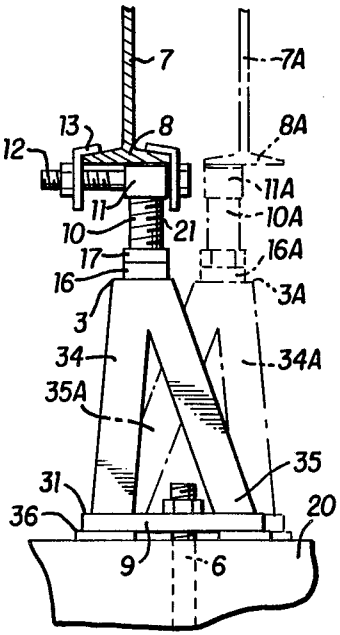
FIG. 5 shows a reversible stanchion, demonstrating an I-beam longitudinal support member in the permitted extremes of misallignment.
Figure 6:
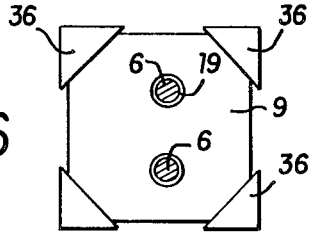
FIG. 6 is a bottom view of the stanchion in FIG. 5.

FIGS. 5 and 6 are a side and a bottom view, respectively, of a stanchion 3 also using two anchor bolts 6 arranged in a line parallel to the longitudinal support member 7, an I-beam 7. Stanchion 3's support and securement means 21 at its upper end, consisting of threaded vertical support member 10, cross tube 11, cross bolt 12, and flanged washers 13, is offset horizontally from the vertical plane of anchor receiving apertures 19.

Stanchion 3 can be installed in either of two positions, and is shown in the second position 3A in FIG. 5, in dotted lines, as stanchion 3A. Cross tube 11 is short in this embodiment, and supports I-beam 7 at any lateral location along the width of its flange member 8. Cross tube 11 is shown at one extreme of this lateral adjustment range under flange 8, and cross tube 11A is shown at the other extreme under flange 8A.

For the particular location of anchor bolts 6 shown in FIG. 5, horizontal misallignment of the I-beam member 7 can be accommodated at the shown location of I-beam 7, or at that of I-beam 7-A, or at any location between.

FIGS. 5 and 6 show spacer pads 6 which are used to space base plate 9 from concrete member 20, in order that horizontal forces at the stanchion's upper end 21 do not cause it to "rock". FIG. 6 also demonstrates the difference in size of anchor bolts 6 and orfices 19 in base plate 9. In this embodiment, body means members 34 and 35 join to base plate 9 at its upper surface 31.

Anchor bolts 6, and orfices 19 in base plate 9 of stanchion 3 of FIGS. 5 and 6, are not in allignment vertically with support and securement means 10, 11, etc., and the vertical centerplane of anchor bolts 6 passes through a first half of base member 9, while the vertical axis of support and securement means 10, 11, etc. passes through the second, opposite half of base member 9.

This maximizes the strength and utility of all portions of stanchion 3 in respect to the design horizontal loading and the larger vertical loading applied along the vertical axis of support and securement means 10, 11, etc.

Figure 8:
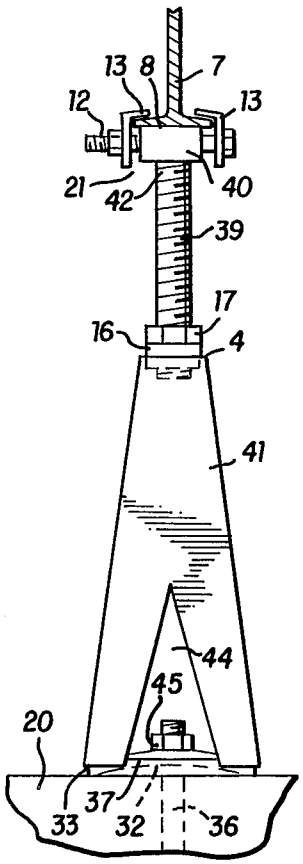
Figure 7:
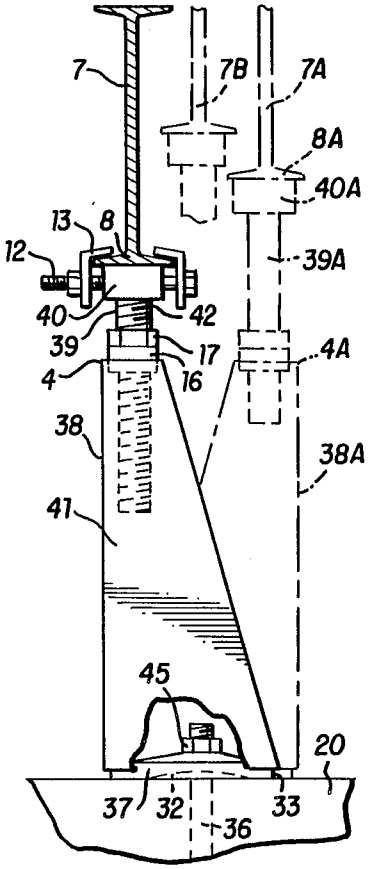
FIG. 7 is a side view, and FIG. 8 a front view, of a form of the invention using one anchor means and one anchor receiving means.

Stanchion 4 of FIGS. 7 and 8 has a body means 41 in the form of an envelope 41, with opening 44 for access to nut 45 on single anchor bolt 6. The shape of body means 41 is approximately that of a non-symmetrical, truncated pyramid with one vertical side 38. The base means 37 of stanchion 4 consists of a cupped base plate member 37. Body means 41 joins cupped base plate member 37 at its perimeter, and because of its shape, base plate member 37 is supported by concrete member 20 on its lower side 32, only near its perimeter 33.

The design using a single anchor bolt 6, along with construction of body means 41 so that it is strong enough to handle horizontal wind loading at its upper end from any direction, permits rotation of the whole stanchion 4 during installation, to correct for unintentional misallignment of frame member 7 with previously installed anchor bolt 36.

The range of misallignment which can be accommodated is shown in FIG. 7. Stanchion 4 supports I-beam member 7 at one extreme, and stanchion 4A, in dotted lines, supports I-beam member 7A at the other extreme. I-beam member 7B is shown in a partial, dotted line drawing, showing one of the infinite number of intermediate support positions.

The accommodation of a large range of misallignment by simply rotating the stanchion 4, is a considerable advantage of, and a principal object of, this invention.

The height adjustable vertical support member 39 is a longer member having a longer cross tube 40 attached to its upper end 42. Cross tube 40 requires no lateral adjustment in respect to I-beam member 7, as the range of lateral support locations furnished by rotation of stanchion 4 is designed to be sufficient for all cases.

A special advantage of this design, and a principal object of this invention, is that since vertical support member 39 is not required to support the vertical load offcenter, for lateral accommodation, it can be much longer and afford a very desirable height adjustment capability in the range of four to six inches. FIG. 7 shows support at three spaced heights for I-beam members 7, 7A, and 7B.

FIG. 8 shows stanchion 4 in a view 90 degrees removed from that of FIG. 7, illustrating opening 44, which affords access to nut 45 on single anchor bolt 6.

The horizontal offset of the vertical axes of the anchor bolt 6 receiving means in base member 37 and vertical support member 39 is one-half of the predetermined range of horizontal misallignment to be accommodated.

Figure 11:
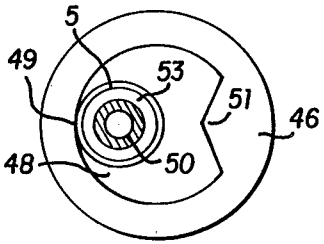
FIGS. 9, 10, and 11 show a stanchion with a round base member, conical body member, and tubular vertical support member, respectively.
Figure 10:
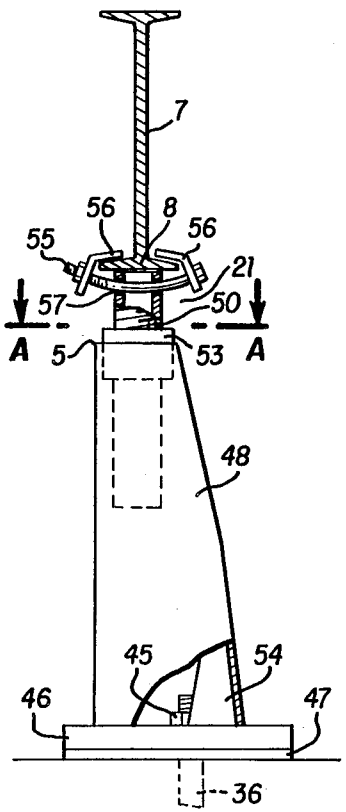
Figure 9:
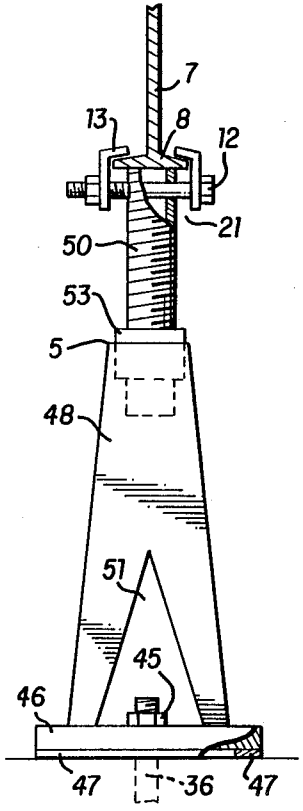

FIGS. 9, 10, and 11 show stanchion 5, which has a round base plate member 46, a round ring-type spacing member 47, and an envelope type body member 48 having a shape approximating a non symmetrical, truncated cone.

Stanchion 5 uses the single anchor bolt 6 with tensioning nut 45, and rotates for accommodation of misallignment of the supported longitudinal support member 7. The offset of the vertical axes of anchor bolt 36 and its receiving means, and vertical support member 50, is illustrated in FIG. 10.

Vertical support member 50 affords a large adjustment range and is supported by receptacle member 53, a deep sleeve-type member. Vertical support member 50 is a tubular member having an aperture 57 near its upper end which coacts with cross bolt 12 and flanged washers 13.

FIG. 10 shows an alternate, shaped cross bolt 55 and altered flanged washers 56. Opening 51 in body means 48 has a strengthening flange 54 at each of its sides.

FIG. 11 is a top view in partial section of stanchion 5, illustrating its round base member 46 and conical body means 48.

Figure 12:
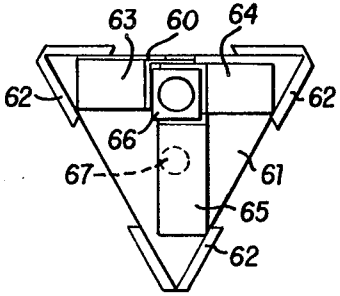
FIG. 12 is a top view of the receptacle member, body means, and base means of a stanchion with a triangular base member.

FIG. 12 is a top view of stanchion 60, shown without its vertical support member and securement means. Stanchion 60 has a triangular base member 61, which uses a triangular spacer pad 62 at each of its corners. Stanchion 60 uses three angle steel members 63, 64, and 65 as its body means. Body members 63 and 64 are the same length, and body member 65 is longer. The receptacle member consists of square nut 66, and the anchor receiving means 67 consists of single aperture 67, shown in dotted lines.

Stanchion 60, like stanchions 4 and 5, accommodates lateral misallignment by rotation about its anchor receiving means, aperture 67, which is offset from the vertical axis of nut 66 by an amount equal to one-half of the predetermined misallignment accommodation capability.

In operation, the user would insert stanchion 1,3,4,5,60 under I-beam 7, or stanchion 2 under sill 23, using the method illustrated in FIGS. 3 and 4, which demonstrates the insertion of stanchion 2 under sill 23. At the time of insertion of stanchion 2, sill 23 is prepositioned in its final location and elevation, and anchor bolts 6 are secured in previously placed concrete member 20.

Stanchion 2 is first positioned with its upper portion 21 to the side of, and above the lower surface of, sill 23, while its apertures 19 are directly above anchor bolts 6. Stanchion 2 is then moved downwardly to the position and location shown in FIG. 3, its lowermost edge 43 contacting concrete member 20, and its apertures 19 engaged with, but not in allignment with, anchor bolts 6.

At this point the upper portion 21 of stanchion 2 is below the horizontal plane of the lower surface of sill 23, and stanchion 2 is then rotated to the position shown in FIG. 4, with its base member 9 horizontal, its support member 10 vertical, and the axes of its apertures 19 alligned with the axes of anchor bolts 6.

Nuts 14 are placed upon anchor bolts 6 securely enough to pre-load, or slightly deform, base member 9, and vertical support member 10 is adjusted upward to sill 23 and attached to it by lag screws though apertures 29 in top plate 28.

A preferred form of the invention is illustrated in FIGS. 7,8,9,10,11, and 12, showing stanchions 4,5, and 60. This form of the invention uses a single anchor bolt 36, coacting with a single aperture 67, illustrated in FIG. 12, in base member 61 of stanchion 60. Stanchions 4 and 5 use the same single aperture 67, which is not apparent in FIGS. 7,8,9, and 10.

Insertion of stanchion 4 under previously placed I-beam 7 is accomplished in the manner described above for insertion of stanchion 2 under sill 23. Lateral misallignment of I-beam 7 with respect to previously placed anchor bolt 6 is then accommodated by rotation of the entire stanchion around anchor bolt 6 and aperture 67, until precise allignment is obtained.

Vertical support member 39 is then adjusted upwardly until cross tube 40 supports I-beam 7, and cross bolt 12 is installed in cross tube 40, a flanged washer 13 secured at each of its respective ends, each in contact with a respective side of flange 8 of I-beam 7.

Nut 45 is then installed upon anchor bolt 6 with enough force to produce a slight deformation in base member 37.

I claim:

1. A foundation stanchion apparatus which is secured at its lower end to a concrete member by tensional anchor means, and which supports and secures a segment of a structure at its upper end, said apparatus comprising:

(a) a horizontally disposed base means having means for receiving said tensional anchor means;

(b) an elongated, vertically disposed body means joined at its lower end to said base means; and joined at its upper end to (c) a support and securement means which is operably engaged with a longitudinal support member of said structure;

(d) said tensional anchor means at each stanchion location is positioned upon a line parallel to said structure's longitudinal support member;

(e) said anchor receiving means in said base means is located within said body means; and (f) said stanchion is supported by said concrete member solely at points near the perimeter of said base means.

2. The apparatus of claim 1, in which said base means consists of a rigid plate member having spacing means on its lower side near its perimeter, and said body means is joined to said base member at least near said perimeter of said base member.

3. The apparatus of claim 1, in which said base means consists of a cupped plate member, and in which contact between said base member and said concrete member is limited to locations adjacent the perimeter of the lower side of said base member.

4. The apparatus of claim 1, wherein said body means consists of multiple angle steel members, secured each to successive locations at the outer portions of said base means, converging toward, and joining together and with the said support and securement means at their upper ends.

5. The apparatus of claim 1, wherein said body means consists of a metal envelope having an opening in at least one area for access to said anchor means.

6. The apparatus of claim 1, in which said base means is constructed to have a strength such that the maximum design horizontal force applied to the upper end of said apparatus from any lateral direction is insufficient to cause permanent deformation of said base means due to tensional forces exerted by said tensional anchor means upon said base means, and wherein the yield strength of the said tensional anchor means is more than sufficient to cause permanent deformation of said base means.

7. The apparatus of claim 1, in which said tensional anchor means consists of multiple anchor bolts embedded in said concrete member, said anchor receiving means consists of multiple apertures in said base means, and each of said bolts engages a respective one of said multiple apertures.

8. The apparatus of claim 1, in which the vertical plane passing through the axes of said multiple apertures is horizontally offset from the vertical centerline of the said support and securement means.

9. The apparatus of claim 1, in which said tensional anchor means consists of a single anchor bolt embedded in said concrete member, said bolt engaging a single aperture in said base means.

10. The apparatus of claim 9, in which the vertical axis of said aperture in said base member is horizontally offset from the vertical centerline of said support and securement means.

11. The apparatus of claim 10, in which its overall construction and strength is such that the design vertical loading force is accommodated, along with the maximum design horizontal wind loading force at its upper end, regardless of the horizontal direction of application of said wind force.

12. The apparatus of claim 1, in which said support and securement means is height adjustable, said means comprising:

(A) a threaded receptacle member with a vertical axis, attached to the upper end of said body means;

(B) a vertically disposed, elongated, threaded vertical support member in operative engagement with said receptacle member; and (C) securement means attached to the upper end of said vertical support member, said means adapted to attachment to said structure's longitudinal support member.

13. The apparatus of claim 12, in which said vertical support member consists of an externally threaded tubular member.

14. The apparatus of claim 12, adapted for use with said structures in which said longitudinal support member consists of a steel I-beam, said securement means comprising:

(A) a cross tube member attached perpendicularly to the said vertical support member at its upper end;

(B) a cross bolt slideably fitted within said cross tube member and perpendicular to said I-beam; and (C) flanged washers slideably fitted upon said cross bolt, near its respective ends, their flange portions forced by said cross bolt into secure contact with the respective edges of said I-beam flange.

15. The apparatus of claim 12, adapted for use with structures in which said longitudinal support member consists of a steel I-beam, and said securement means comprising:

(A) a horizontal aperture in the upper end of said vertical support member;

(B) a shaped cross bolt loosely fitted within said aperture and approximately perpendicular to said I-beam; and (C) flanged washers slideably fitted upon said cross bolt, near its respective ends, their flange portions forced by said cross bolt into secure contact with the respective edges of said I-beam flange.

16. A foundation stanchion apparatus which is secured at its lower end to a concrete member by tensional anchor means, and which supports and secures a segment of a structure at its upper end, said apparatus comprising:

(a) a horizontally disposed base means having means for receiving said tensional anchor means;

(b) an elongated, vertically disposed body means joined at its lower end to said base means; and joined at its upper end to (c) a height adjustable support and securement means which is operably engaged with a longitudinal support member of said structure;

(d) a threaded receptacle member with a vertical axis, attached to the upper end of said body means;

(e) a vertically disposed, elongated, threaded vertical support member in operative engagement with said receptacle member;

(f) securement means attached to the upper end of said vertical support member, said means adapted to attachment to said structure's longitudinal support members;

(g) a cross tube member attached perpendicularly to said vertical support member at its upper end;

(h) a cross bolt slideably fitted within said cross tube member and perpendicular to said I-beam;

(i) flanged washers slideably fitted upon said cross bolt, near its respective ends, their flange portions forced by said cross bolt into secure contact with the respective edges of said I-beam flange;

(j) said tensional anchor means at each stanchion location is positioned upon a line parallel to said structure's longitudinal support member;

(k) said anchor receiving means in said base means is located within said body means; and (l) said stanchion is supported by said concrete member solely at points near the perimeter of said base means.

17. A foundation stanchion apparatus which is secured at its lower end to a concrete member, and which supports and secures a segment of a structure at its upper end by attachment to said structure's underframe, said apparatus comprising:

(a) multiple tensional anchor means embedded in said concrete member at each stanchion location, said multiple anchor means located at points along a line parallel to said underframe of said supported structure;

(b) horizontally disposed base means having multiple anchor receiving means, said anchor receiving means sized to loosely fit said anchor means;

(c) an elongated, vertically disposed body means, joined at its lower end to said base means at points near the perimeter of said base means;

(d) said anchor receiving means located in said base means within the area described by a line connecting said points at which said body means joins said base means;

(e) height adjustable support and securement means joined to the upper end of said body means and operably engaged with said structure's underframe;

(f) said stanchion supported by said concrete member at points near the perimeter of said base means;

(g) the vertical centerline of said height adjustable support and securement means horizontally offset from the vertical plane passing through said multiple anchor receiving means in said base means;

(h) said base means constructed to have a strength such that the maximum design horizontal load force applied to the upper end of said stanchion is insufficient to cause permanent deformation of said base means due to tensional force applied by said tensional anchor means upon said base means, and the maximum design tensional strength of said tensional anchor means is more than sufficient to cause permanent deformation of said base means and wherein said support and securement means and said body means accommodate and transfer to said base means said horizontal load force along with said stanchion's maximum design vertical load force.

18. A foundation stanchion apparatus which is secured at its lower end to a concrete member, and which supports and secures a segment of a structure at its upper end by attachment to said structure's underframe, said apparatus comprising:

(a) a single tensional anchor member embedded in said concrete member at each stanchion location;

(b) a horizontally disposed base means having a single anchor receiving means;

(c) an elongated, vertically disposed body means, joined at its lower end to said base means at points near the perimeter of said base means;

(d) said anchor receiving means located in said base means within the area described by a line connecting said points at which said body means joins said base means;

(e) height adjustable support and securement means joined to the upper end of said body means and operably engaged with said structure's underframe;

(f) said stanchion supported by said concrete member at points near the perimeter of said base means;

(g) the vertical centerline of said height adjustable support and securement means horizontally offset from the vertical centerline of said single anchor receiving means in said base means; and (h) said base means constructed to have a strength such that the maximum design horizontal load force applied to the upper end of said stanchion from any lateral direction is insufficient to cause permanent deformation of said base means due to tensional force applied by said tensional anchor means upon said base means, and the maximum design tensional strength of said tensional anchor means is more than sufficient to cause permanent deformation of said base means and wherein said body means and said support and securement means accommodate and transfer to said base means said stanchion's design vertical load force, along with said maximum design horizontal load force applied to the upper end of said stanchion, regardless of the lateral direction of application of said horizontal load force.

19. The stanchion of claim 18, in which said base means comprises:

(a) a base plate member;

(b) said base plate member is shaped downwardly in the areas in which said body member joins said base plate member; and (c) said base plate member is supported by said concrete member at said downwardly shaped areas, said base plate member's interior portion positioned above said concrete member.

20. The stanchion of claim 18, in which said base means comprises:

(a) a plate member in a triangular shape;

(b) each corner of said triangular base plate having a spacer pad joined to its underside and an angle iron body member joined to its upper side;

(c) said angle iron body members joined to a square receptacle member at their upper ends, said square receptacle member operably connected to said support and securement means; and (d) said receptacle member having its outermost side parallel to a side of said triangular base plate, and positioned above the center point of said side of said base plate.

21. The stanchion of claim 18, in which said structure's underframe comprises a steel I-beam, and said height adjustable support and securement means comprises:

(a) a threaded receptacle member with a vertical axis, attached to the upper end of said body means;

(b) an externally threaded, tubular, vertical support member in operative engagement with said receptacle member;

(c) a horizontal aperture near the upper end of said vertical support member;

(d) a cross bolt fitted within said aperture and perpendicular to said I-beam frame; and (e) flanged washers slideably fitted upon said cross bolt near its respective ends, their flange portions in contact with the respective edges of said I-beam's lower flange.

22. The stanchion of claim 21 in which said cross bolt is shaped upwardly at its respective ends.

* * * * *